US006149098A

United States Patent [19]

Kuhn et al.

[11] Patent Number: 6,149,098

[45] **Date of Patent: *Nov. 21, 2000**

[54] PROCESS TO SPOOL A LONGITUDINALLY CUT MATERIAL SHEET AND A DEVICE TO EXECUTE THE PROCESS

[75] Inventors: Friedrich Kuhn; Jens Krueger, both of Heidenheim, Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,039

[22] Filed: Sep. 10, 1997

[30] Foreign Application Priority Data

Sep. 11, 1996 [DE] Germany ..... 196 36 894

[51] Int. Cl.[7] ..... B65H 18/20; B65H 18/26

[52] U.S. Cl. ..... 242/530.4; 242/541.6

[58] Field of Search ..... 242/530.4, 541.4, 242/541.5, 541.6, 541.7, 542.1, 541.2, 541.3

[56] References Cited

U.S. PATENT DOCUMENTS

| | | | |
|---|---|---|---|
| 1,888,810 | 11/1932 | Sieg | 242/542.1 |
| 1,984,784 | 12/1934 | Cameron | 242/541.5 |
| 3,009,666 | 11/1961 | Mosar | 242/541.5 |
| 3,822,836 | 7/1974 | Troyer et al. | 242/542.1 |
| 3,937,410 | 2/1976 | Justus | 242/530.1 |
| 5,165,618 | 11/1992 | Ruff | 242/530.4 |
| 5,249,756 | 10/1993 | Biagiotti | 242/541.3 |
| 5,257,748 | 11/1993 | Morizzo | 242/542.1 |
| 5,368,252 | 11/1994 | Biagiotti | 242/542.1 |
| 5,505,405 | 4/1996 | Vigneau | 242/542.1 |
| 5,518,199 | 5/1996 | Welp et al. | 242/542.1 |
| 5,743,483 | 4/1998 | Scherer et al. | 242/541.6 |
| 5,785,271 | 7/1998 | Leskinen et al. | 242/530.1 |

FOREIGN PATENT DOCUMENTS

| | | | |
|---|---|---|---|
| 0524158 | 1/1993 | European Pat. Off. . | |
| 453984 | 12/1927 | Germany . | |
| 1141152 | 12/1952 | Germany . | |
| 1229361 | 3/1961 | Germany . | |
| 3243994 | 5/1984 | Germany . | |
| 3541906 | 2/1987 | Germany . | |
| 3816777 | 12/1988 | Germany . | |
| 3832601 | 12/1989 | Germany . | |
| 3843246 | 5/1990 | Germany . | |
| 59-48346 | 3/1984 | Japan | 242/542.1 |
| 3-77718 | 4/1991 | Japan | 242/542.1 |
| 2117935 | 10/1983 | United Kingdom . | |

OTHER PUBLICATIONS

Patent Abstracts of Japan of JP 60–157441, M–440, vol. 9, No. 322 (Dec. 18, 1985).

Klein, "Rollenschneid—und Wicklemachinen," *Papier+ Kunstsoff–Verabeiter,* 11–77, pp. 28, 30, 32 ,34–36, 39, and 40.

Hansch, "Umrollerantriebe fur die Papierindustrie," *Das Papier,* 26. Jg., H.5, pp. 205–209 (1972).

*Primary Examiner*—John M. Jillions

*Attorney, Agent, or Firm*—Greenblum & Bernstein, P.L.C.

[57] ABSTRACT

Process and device to spool longitudinally cut partial sheets from a material sheet having a sheet width. The process may include forming a spooling roll from each partial sheet such that the formed spooling rolls rest on at least two spooling beds including individually motorized spooling-support rolls. During at least a beginning of the spooling process, the process also may include pressing at least one of the spooling rolls being formed against its respective spooling bed with a loading roll, positioning the at least one spooling roll with the loading roll in a middle portion of sheet width, and motorizing the loading roll independently of the support rolls to initiate an adjustable portion of a turning moment exerted onto the at least one spooling roll. The device may include two spooling bed tracks composed of spooling support rolls to receive spooling rolls to be formed from the longitudinally cut partial sheets, at least one loading roll that is adjustably positionable onto one of the spooling rolls, and an individually controllable motor associated with each spooling support roll and with the at least one loading roll. The one of the spooling rolls may be formed in a middle portion of the sheet width.

44 Claims, 2 Drawing Sheets

PROCESS TO SPOOL A LONGITUDINALLY CUT MATERIAL SHEET AND A DEVICE TO EXECUTE THE PROCESS

CROSS-REFERENCE TO RELATED APPLICATION

The present application claims priority under 35 U.S.C. § 119 of German Patent Application No. 196 36 894.4 filed Sep. 11, 1996, the disclosure of which is expressly incorporated by reference herein in its entirety.

BACKGROUND OF THE INVENTION

1. Field of the Invention

The present invention relates to a process to spool a longitudinally cut material sheet, e.g., a paper sheet. The spooling rolls, which result from the partial sheet, are supported by spooling bed tracks formed by two spooling support rolls. The present invention further relates to a device for carrying out the above-mentioned process. The device is preferably constructed as a three-drum-roll cutting machine. Alternatively, the spooling bed tracks may be formed by four spooling support rolls.

2. Discussion of Background Information

DE-PS 32 43 994 and DE-PS 35 41 906 discuss a three-drum roll cutting machine. The three spooling support rolls create two spooling bed tracks so that the partial sheet, i.e., created after the longitudinal cut, can be spooled into spooling rolls partially on one and partially on the other spooling bed track. Each individual spooling roll is formed on a sleeve and is guided with two spooling support frames. Each spooling support frame has a vertically movable sleeve guidance such that a grip header is positioned in a rotatable fashion. The two grip headers engage into the sleeve on the two face sides of the spooling roll being created. If necessary, this construction also allows the weight of the three spooler rolls being created to be counteracted. This is primarily utilized when the spooling roll diameter has become relatively large.

However, in the beginning section of the spooling device, i.e., when the spooling diameter is still very small, it is necessary to press the spooling roll against the respective support roll pair with the aid of a loading roll. In this way, the spooling roll remains securely positioned in the spooling bed track.

It is also known, e.g., from DE '994, that each support roll can be individually motorized. In other words, each of the support rolls has an individually controllable drive. Thus, the user can initiate turning moments of different magnitudes on one spooling roll (resting on two of the support rolls) over the two support rolls. In this manner, the user tries to achieve a certain spooling strength in the spooling roll. However, this is not always achieved at the desired level, particularly when at least one of the partial sheets (and, therefor, the entire spooling roll being created) exhibits a large width. It can then be necessary to create a larger spooling strength in the beginning phase of the spooling process than was previously possible.

SUMMARY OF THE INVENTION

In accordance with the present invention, the above-noted drawbacks and deficiencies of the prior art may be overcome.

In particular, the present invention may be directed to a process to spool a longitudinally cut partial sheet of a material sheet, e.g., paper. The process includes, e.g., at least one of the spooling rolls being selected in a middle section of a total sheet width to create, via at least one of individually driven loading rolls, a higher spooling strength than available in the prior art.

The spooling roll is selected in the middle section of the total sheet width because in many cases the quality of the material sheet may be higher, or at least more uniform, in the middle section of the total sheet width than in the shoulder (or edge) sections of the sheet. The spooling rolls may be formed to meet higher demands in further processing, e.g., in press machines, and may generally exhibit a relatively larger partial sheet width in the middle section of the total sheet width.

In accordance with the present invention, a higher turning moment may be introduced in the respective spooling rolls than was possible in the prior art. Further, the present invention not only allows the turning moment to be introduced and divided between the two support rolls, but also transfers a certain portion of the turning moment to the spooling roll over at least one loading roll. Thus, in accordance with the present invention, rotational forces may be introduced, not only in two, but in three locations of the slowly expanding circumference of the spooling roll. This results in spooling rolls having a relatively large width which, particularly in the core area, exhibits a significantly larger spooling strength than the prior art.

The present invention is directed to a process to spool longitudinally cut partial sheets from a material sheet having a sheet width. The process may include forming a spooling roll from each partial sheet such that the formed spooling rolls rest on at least two spooling beds including individually motorized spooling-support rolls. During at least a beginning of the spooling process, the process also may include pressing at least one of the spooling rolls being formed against its respective spooling bed with at least one loading roll, positioning the at least one spooling roll with the loading roll in a middle portion of sheet width, and motorizing the at least one loading roll independently of the support rolls to initiate an adjustable portion of a turning moment exerted onto the at least one spooling roll.

In accordance with another feature of the present invention, the process may also include positioning a plurality of spooling rolls in the middle section of the sheet width and assigning at least one individually motorizable loading roll to each of the spooling rolls.

In accordance with another feature of the present invention, the process may also include assigning at least one individually motorizable loading roll to each spooling roll.

In accordance with still another feature of the present invention, the process may further include varying a magnitude of a turning moment to be introduced to the spooling roll via the at least one loading roll in dependence upon a changing process parameter. Further, the magnitude of the turning moment may be lowered and the changing process parameter may be an increasing spooling roll diameter.

In accordance with a further feature of the present invention, the process may include lowering a magnitude of the loading force acting on the spooling roll and a magnitude of the turning moment in dependence upon an increasing spooling roll diameter. Further, the lowering of the magnitude of the loading force and the magnitude of the turning moment may be automatically and continuously performed.

In accordance with a still further feature of the present invention, the material sheet may include a paper sheet.

The present invention may also be directed to a spooling machine for spooling longitudinally cut partial sheets from a material sheet having a sheet width. The spooling machine may include two spooling bed tracks composed of spooling support rolls to receive spooling rolls to be formed from the plurality of longitudinally cut partial sheets, at least one loading roll that is adjustably positionable onto one of the spooling rolls, and an individually controllable motor associated with each spooling support roll and with the at least one loading roll. The one of the spooling rolls may be formed in a middle portion of the sheet width.

In accordance with another feature of the present invention, the spooling machine may also include a lifting device such that the loading roll may be mounted on the lifting device. Further, the lifting device may provide a control for a magnitude of a loading force acting on the spooling roll. Still further, the lifting device may be coupled with the loading roll to selectively remove the loading roll from spooling roll after a predetermined diameter increase.

The present invention may be directed to a process for spooling longitudinally cut partial sheets of a sheet material having a sheet width. The process may include forming at least two spooling beds with at least three spooling support rolls, independently driving each of the at least three spooling support rolls, forming spooling rolls on the at least two spooling beds, at least one of the spooling rolls being formed in an interior portion of the sheet, exerting a loading force on the at least one of the spooling rolls at least during an initial start-up portion of the spooling roll formation with a load roll, and driving the load roll independently of the at least three spooling support rolls.

In accordance with another feature of the present invention, the interior portion of the sheet may include a middle portion of the sheet width. Further, the initial start-up portion may extend until the at least one of the spooling rolls reaches a predetermined diameter.

In accordance with a further feature of the present invention, the process may include lifting the load roll away from the spooling roll after the start-up portion is completed.

The present invention may be directed to a spooling device for spooling longitudinally cut partial sheets from a material sheet having a sheet width. The spooling device may include at least three spooling support rolls forming at least two spooling bed tracks, each spooling bed track adapted to receive at least one spooling roll, at least one loading roll adapted to be adjustably positionable onto one of the spooling rolls, and individually controllable motors respectively coupled with each spooling support roll and with the at least one loading roll. The at least one loading roll may be positioned to exert a loading force onto the one spooling roll in a vicinity of the a middle portion of the sheet width.

In accordance with another feature of the present invention, the spooling device may also include a lifting device coupled to adjustably position the load roll.

In accordance with yet another feature of the present invention, the at least three spooling support rolls may include a central support roll and outer support rolls positioned on opposite sides of the central support roll. Further, the central support roll may have a diameter greater than the outer support rolls, and the outer support rolls may have a same diameter.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
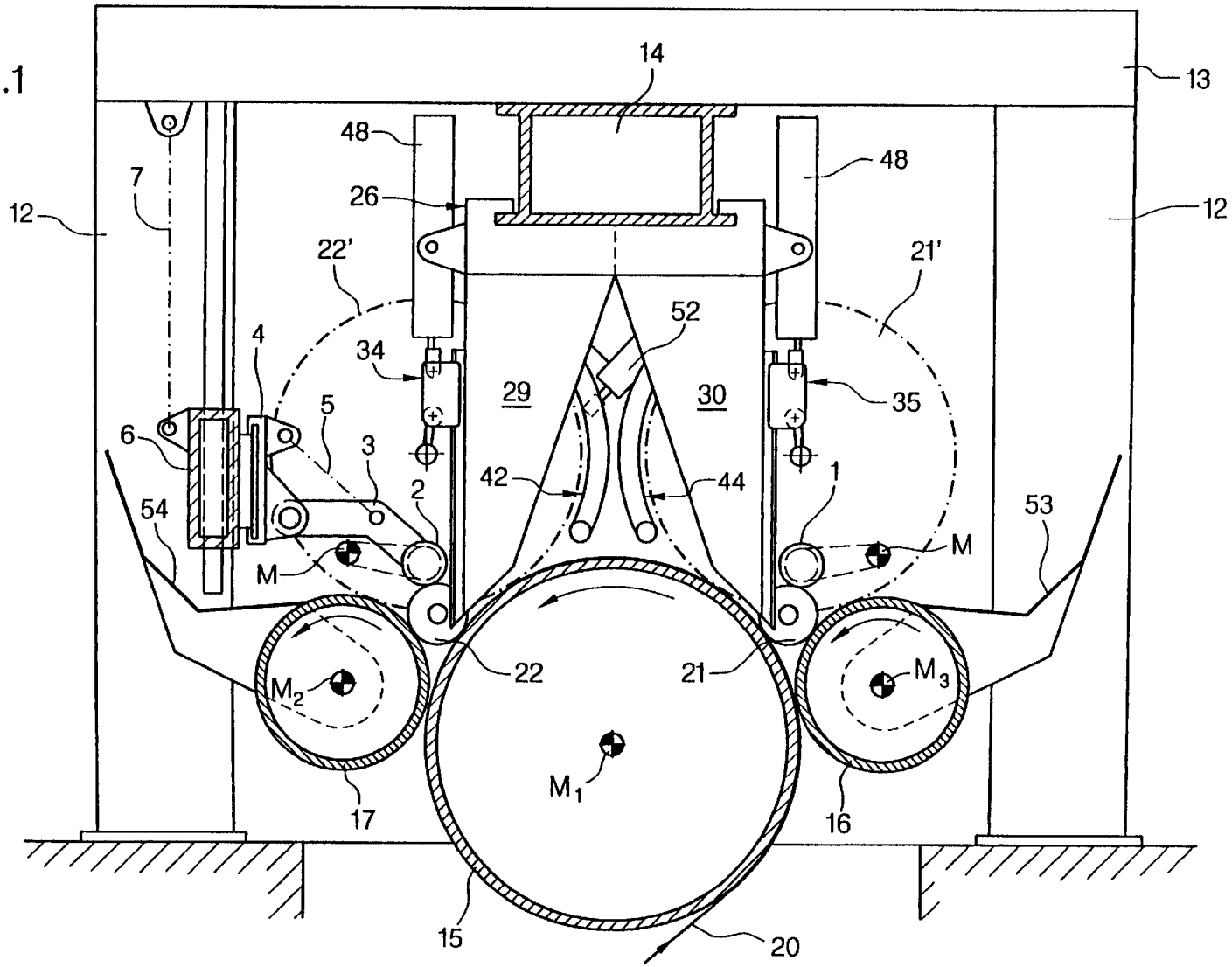
FIG. 1 schematically illustrates a partial side sectional view of spooling machine in accordance with the present invention.
Figure 2:
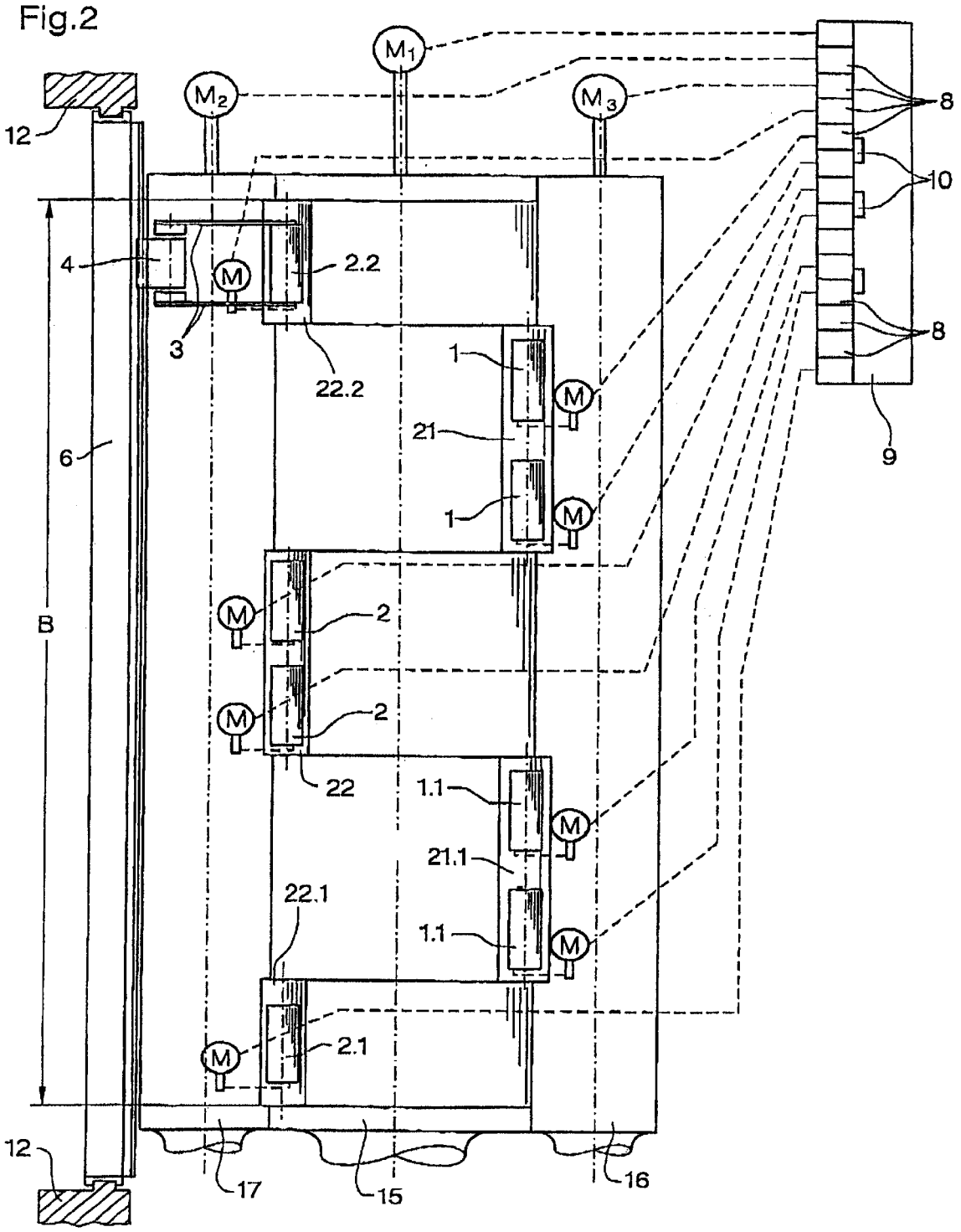
FIG. 2 schematically illustrates a top view of the spooling machine depicted in FIG. 1 at a beginning phase of a spooling process.

A spooling machine is illustrated in FIGS. 1 and 2 and includes a machine frame having stands 12 that are coupled by traverse members 13 (FIG. 1). Traverse members 13 may be coupled in a middle of the machine via a longitudinal carrier 14. Three adjacent support rolls 15, 16, and 17 may extend parallel to each other and to longitudinal carrier 14. Each of support rolls 15, 16, and 17 may be equipped with a respective motor M1, M2, and M3 and driven at a speed of, e.g., approximately 2400 m/min, and up to a desired speed of approximately 3000 m/min. Support rolls 16 and 17, which are positioned as outer support rolls, may extend at a same height and have the same diameter. The diameter of support rolls 16 and 17, however, may be smaller than the diameter of support roll 15, which is positioned as a middle (central) support roll. Each adjacent support roll, i.e., 15 and 17, and 15 and 16, may form at least a portion of a spooling bed track.

A longitudinally cut material sheet 20, e.g., a paper sheet, may have a total width B, as shown in FIG. 2, and may be fed into the machine, e.g., from the bottom, via central support roll 15. At least one of the cut partial sheets may be spooled on support rolls 15 and 16 into a spool 21, and at least one second partial sheet may be spooled on support rolls 15 and 17 into a spool 22.

FIG. 2 further illustrates that, in accordance with the present invention, e.g., five spooling rolls 21, 21.1, 22, 22.1, and 22.2 may be created or formed. Because the partial sheets may be fed, e.g., in an alternating fashion into the two spooling beds, an axial distance, e.g., between two spooling rolls 21 and 21.1, may be created in one spooling bed that corresponds to a width of another spooling roll, e.g., spooling roll 22, that may be created in the other spooling bed.

Spooling support frames 29 and 30 may be placed on support carrier 14. Spooling support frames 29 and 30, which are slidable in the longitudinal direction, may extend downward into a respective spooling bed and may serve for the two-sided guidance of spooling rolls 21 and 22. Each of the spooling support frames 29 and 30 may be equipped with a sleeve guidance device 34 and 35, respectively, that can be vertically moved via a lifting device 48. Each sleeve guidance device 34 and 35 may carry an axially movable grip header that may engage with a center of respective spooling rolls 21' and 22', respectively, created by a spooling sleeve. FIG. 1 depicts sleeve guidance devices 34 and 35 in a top position that is occupied when spooling rolls 21', 22' reach their maximum diameter.

To eject finished spooling rolls 21', 22' from their respective spooling bed track, ejection devices 42 and 44 may be designed over middle support roll 15 and may include a pivot drive 52. Each of outer support rolls 16 and 17 may be assigned a roll lowering device 53 and 54 for removing the finished spooling rolls from the machine.

Middle support roll 15 may include, e.g., preferably in accordance with DE-PS 3843246, a perforated roll sleeve and a suction connection. A vacuum may be temporarily created in the interior of support roll 15, particularly to hold new initial sheet sections to support roll 15 during a roll transition after the dissection of the partial sheets.

As long as spooling rolls 21 and 22 are still relatively small, they may each be pressed onto the support rolls via loading rolls 1 and 2, with a loading force of, e.g., up to approximately 5 N. For example, in the left half of FIG. 2, the positioning and guiding of loading rolls 1 and 2 is depicted. Each loading roll may be positioned in a pivotable position on a free end of a lever pair 3 that may be hinged on a horizontally traversable sled 4. A lifting device 5 may be provided to pivot lever pair 3 either up or down and to control the loading force. Sled 4 may be supported on a longitudinal carrier 6 that is slidable via a lifting device 7. Once the spooling rolls reach a certain diameter, e.g., between approximately 600 and 800 mm, and preferably approximately 0.5 m, loading rolls 1 and 2 may generally be removed upwards.

FIG. 2 shows an exemplary illustration of the present invention in which a single loading roll 2.1 and 2.2 may be assigned to the outer, relatively narrow spooling rolls 22.1 and 22.2, and two (or more) support rolls 1, 2, and 1.1 may be located to rest on the middle, relatively wide spooling rolls 21, 22, and 21.1.

Each of the loading rolls depicted in FIG. 2 may be equipped with a motor M (schematically displayed) and driven at a speed of, e.g., approximately 2400 m/min, and up to a desired speed of approximately 3000 m/min. A control unit 8, provided in a control center 9, may be provided for each of the motors M and for each of the support roll motors M1, M2, and M3. Thus, each of the motors may be individually controllable. Further, selected control units 8 may be coupled to each other as depicted by element 10. In this manner, the motors of, e.g., loading roll 2, that is assigned to a certain spooling roll, e.g., spooling roll 22, may be controlled together.

In an alternative to FIG. 2, loading rolls 2.1 and 2.2 of outer spooling rolls 22.1 and 22.2 may be formed without an associated motor.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A process to spool longitudinally cut partial sheets from a material sheet having a sheet width comprising:

forming a spooling roll from each partial sheet, the formed spooling rolls resting on at least two spooling beds comprising individually motorized spooling-support rolls;

pressing at least one of the spooling rolls being formed against its respective spooling bed with at least one loading roll during at least a beginning of the spooling process;

positioning a plurality of spooling rolls with the at least one loading roll in a middle portion of sheet width;

motorizing the at least one loading roll independently of the support rolls to initiate an adjustable portion of a turning moment exerted onto the at least one spooling rol; and assigning at least one individually motorizable loading roll to each of the spooling rolls.

2. The process in accordance with claim 1, further comprising:

varying a magnitude of a turning moment to be introduced to the spooling roll via the at least one loading roll in dependence upon a changing process parameter.

3. The process in accordance with claim 2, wherein the magnitude of the turning moment is lowered and the changing process parameter is an increasing spooling roll diameter.

4. The process according to claim 1, further comprising decreasing a magnitude of the loading force acting on the spooling roll as the diameter of the roll increases.

5. The process in accordance with claim 1, wherein the material sheet comprises a paper sheet.

6. The process in accordance with claim 1, further comprising lowering a magnitude of the loading force acting on the spooling roll and a magnitude of the turning moment in dependence upon an increasing spooling roll diameter.

7. The process in accordance with claim 6, wherein the lowering of the magnitude of the loading force and the magnitude of the turning moment is automatically and continuously performed.

8. The process in accordance with claim 1, further comprising decreasing a turning moment of the spooling roll as the diameter of the roll increases.

9. A spooling machine for spooling longitudinally cut partial sheets from a material sheet having a sheet width comprising:

two spooling bed tracks composed of spooling support rolls to receive spooling rolls to be formed from the longitudinally cut partial sheets;

at least one loading roll that is adjustably positionable onto one of the spooling rolls;

an individually controllable motor associated with each spooling support roll and with the at least one loading roll;

positioning a plurality of spooling rolls in the middle section of the sheet width; and assigning at least one individually motorizable loading roll to each of the spooling rolls.

10. The spooling machine in accordance with claim 9, further comprising a lifting device; and the loading roll being mounted on the lifting device.

11. The spooling device in accordance with claim 10, the lifting device providing a control for a magnitude of a loading force acting on the spooling roll.

12. The spooling device in accordance with claim 10, the lifting device being coupled with the loading roll to selectively remove the loading roll from spooling roll after a predetermined diameter increase.

13. The spooling device in accordance with claim 9, the material sheet comprising a paper sheet.

14. The spooling device in accordance with claim 9, the at least one loading roll adapted to be driven by the individually controllable motor and arranged to decrease a turning moment of the spooling roll as the diameter of the roll increases.

15. The spooling device in accordance with claim 9, the at least one loading roll being adapted to decrease a magnitude of the loading force acting on the spooling roll as the diameter of the roll increases.

16. A process for spooling longitudinally cut partial sheets of a sheet material having a sheet width, the process comprising:

forming at least two spooling beds with at least three spooling support rolls;

independently driving each of the at least three spooling support rolls;

forming spooling rolls on the at least two spooling beds, exerting a loading force on the at least one of the spooling rolls at least during an initial start-up portion of the spooling roll formation with at least one load roll; and driving the at least one load roll independently of the at least three spooling support rolls positioning a plurality of spooling rolls in the middle section of the sheet width; and assigning at least one individually motorizable loading roll to each of the spooling rolls.

17. The process according to claim 16, the initial start-up portion extending until the at least one of the spooling rolls reaches a predetermined diameter.

18. The process according to claim 16, further comprising lifting the at least one load roll away from the spooling roll after the start-up portion is completed.

19. The process according to claim 16, further comprising decreasing a turning moment of the spooling roll as the diameter of the roll increases.

20. The process according to claim 16, further comprising decreasing a magnitude of the loading force acting on the spooling roll as the diameter of the roll increases.

21. A spooling device for spooling longitudinally cut partial sheets from a material sheet having a sheet width comprising:

at least three spooling support rolls forming at least two spooling bed tracks, each spooling bed track adapted to receive at least one spooling roll;

at least one loading roll adapted to be adjustably positionable onto one of the spooling rolls;

individually controllable motors respectively coupled with each spooling support roll and with the at least one loading roll;

the at least one loading roll positioned to exert a loading force onto the one spooling roll in a vicinity of the a middle portion of the sheet width.

positioning a plurality of spooling rolls in the middle section of the sheet width; and assigning at least one individually motorizable loading roll to each of the spooling rolls.

22. The spooling device according to claim 21, further comprising a lifting device coupled to adjustably position the load roll.

23. The spooling device according to claim 21, the at least three spooling support rolls comprising a central support roll and outer support rolls positioned on opposite sides of the central support roll.

24. The spooling device according to claim 23, the central support roll have a diameter greater than the outer support rolls.

25. The spooling device according to claim 24, the outer support rolls having a same diameter.

26. The spooling device in accordance with claim 21, the at least one loading roll being adapted to decrease a magnitude of the loading force acting on the spooling roll as the diameter of the roll increases.

27. The spooling device according to claim 21, the at least one loading roll adapted to be driven by the individually controllable motor and arranged to decrease a turning moment of the spooling roll as the diameter of the roll increases.

28. A process to spool longitudinally cut partial sheets from a material sheet having a sheet width comprising:

forming a spooling roll from each partial sheet, the formed spooling rolls resting on at least two spooling beds comprising individually motorized spooling-support rolls;

pressing at least one of the spooling rolls being formed against its respective spooling bed with at least one loading roll during at least a beginning of the spooling process;

positioning a plurality of spooling rolls with the at least one loading roll in a middle portion of sheet width;

the spooling bed supporting the at least one spooling roll also supporting at least one additional spooling roll; and motorizing the at least one loading roll independently of the support rolls to initiate an adjustable portion of a turning moment exerted onto the at least one spooling roll.

29. The process in accordance with claim 28, further comprising:

varying a magnitude of a turning moment to be introduced to the at least one spooling roll via the at least one loading roll in dependence upon a changing process diameter.

30. The process in accordance with claim 28, further comprising lowering a magnitude of the loading force acting on the at least one spooling roll and a magnitude of the turning moment in dependence upon an increasing spooling roll diameter.

31. The process in accordance with claim 28, further comprising decreasing a turning moment of the spooling roll as the diameter of the roll increases.

32. The process according to claim 28, further comprising decreasing a magnitude of the loading force acting on the at least one spooling roll as the diameter of the roll increases.

33. A spooling machine for spooling longitudinally cut partial sheets from a material sheet having a sheet width comprising:

two spooling bed tracks composed of spooling support rolls to receive spooling rolls to be formed from the longitudinal cut partial sheets;

at least one loading roll that is adjustably positionable onto one of the spooling rolls;

an individually controllable motor associated with each spooling support roll and with the at least one loading roll;

the spooling bed track supporting the one spooling roll also supporting at least one additional spooling roll; and the one of the spooling rolls being formed in a middle portion of the sheet width.

34. The spooling machine in accordance with claim 33, further comprising a lifting device and the at least one loading roll being mounted on the lifting device.

35. The spooling device in accordance with claim 33, the at least one loading roll adapted to be driven by the individually controllable motor and arranged to decrease a turning moment of the one of the spooling rolls as the diameter of the roll increases.

36. The spooling device in accordance with claim 33, the at least one loading roll being adapted to decrease a magnitude of the loading force acting on the one of the spooling rolls as the diameter of the roll increases.

37. A process for spooling longitudinally cut partial sheets of a sheet material having a sheet width, the process comprising:

forming at least two spooling beds with at least three spooling support rolls;

independently driving each of the at least three spooling support rolls;

forming spooling rolls on the at least two spooling beds, at least one of the spooling rolls being formed in an interior portion of the sheet;

exerting a loading force on the at least one of the spooling rolls at least during an initial start-up portion of the spooling roll formation with at least one load roll;

the spooling bed supporting the at least one spooling roll also supporting at least one additional spooling roll; and driving the at least one roll independently of the at least three spooling support rolls.

38. The process according to claim 37, wherein the interior portion of the sheet comprises a middle portion of the sheet width.

39. The process according to claim 37, the initial start-up portion extending until the at least one spooling roll reaches a predetermined diameter.

40. The process according to claim 37, further comprising decreasing a turning moment of the at least one spooling roll as the diameter of the roll increases.

41. The process according to claim 37, further comprising decreasing a magnitude of the loading force acting on the at least one spooling roll as the diameter of the roll increases.

42. A spooling device for spooling longitudinally cut partial sheets from a material sheet having a sheet width comprising:

at least three spooling support rolls forming at least two spooling bed tracks, each spooling bed track adapted to receive at least one spooling roll;

at least one loading roll adapted to be adjustably positionable onto one of the spooling rolls;

individually controllable motors respectively coupled with each spooling support roll and with the at least one loading roll;

the spooling bed track supporting the one spooling roll also supporting at least one additional spooling roll; and the at least one loading roll positioned to exert a loading force onto the one spooling roll in a vicinity of the a middle portion of the sheet width.

43. The spooling device according to claim 42, the at least one loading roll adapted to be driven by an individually controllable motor and arranged to decrease a turning moment of the one spooling roll as the diameter of the roll increases.

44. The spooling device in accordance with claim 42, the at least one loading roll being adapted to decrease a magnitude of the loading force acting on the one spooling roll as the diameter of the roll increases.

* * * * *